United States Patent [19]

Nelson et al.

[11] 4,422,882

[45] Dec. 27, 1983

[54] PULSED LIQUID JET-TYPE CLEANING OF HIGHLY HEATED SURFACES

[75] Inventors: John E. Nelson; Charles W. Hammond; Rolland E. Huston, all of Lancaster; Michael R. Helton, Englewood, all of Ohio

[73] Assignee: The Babcock & Wilcox Company, New Orleans, La.

[21] Appl. No.: 335,351

[22] Filed: Dec. 29, 1981

[51] Int. Cl.[3] ..... B08B 3/02

[52] U.S. Cl. ..... 134/22.18; 134/34; 165/95; 122/390; 239/11; 239/101; 239/124

[58] Field of Search ..... 134/34, 17, 22.12, 22.18, 134/24, 168 R, 168 C, 169 R, 169 C, 171; 165/95; 122/390; 239/11, 101, 124, 126

[56] References Cited

U.S. PATENT DOCUMENTS

| | | | |
|---|---|---|---|
| 3,212,378 | 10/1965 | Rice | 134/17 X |
| 3,343,794 | 9/1967 | Voitsekhovsky | 239/101 |
| 3,360,400 | 12/1967 | Evans et al. | 134/34 |
| 3,468,481 | 9/1969 | Cooley | 239/101 |
| 3,782,336 | 1/1974 | Nelson | 122/390 X |
| 3,810,417 | 5/1974 | Sieke | 137/624.13 X |
| 3,883,075 | 5/1975 | Edney | 239/101 |
| 4,135,534 | 1/1979 | Autelli | 165/95 X |

FOREIGN PATENT DOCUMENTS

| | | |
|---|---|---|
| 672336 | 5/1952 | United Kingdom . |
| 725276 | 3/1955 | United Kingdom . |
| 1050746 | 12/1966 | United Kingdom . |
| 1091844 | 11/1967 | United Kingdom . |
| 1258538 | 12/1971 | United Kingdom . |
| 1335630 | 10/1973 | United Kingdom . |
| 1462371 | 1/1977 | United Kingdom . |

*Primary Examiner*—Richard V. Fisher

*Attorney, Agent, or Firm*—Harness, Dickey & Pierce

[57] ABSTRACT

A method and apparatus for removing adherent deposits from high temperature surfaces such as the fire sides of the tubes of boilers while steaming is disclosed as employing a sootblower to project a moving pulsed jet of liquid against the deposits. The peak impact pressure of the jet is increased by pulsing means disclosed as of a fluidic or rotary type.

9 Claims, 14 Drawing Figures

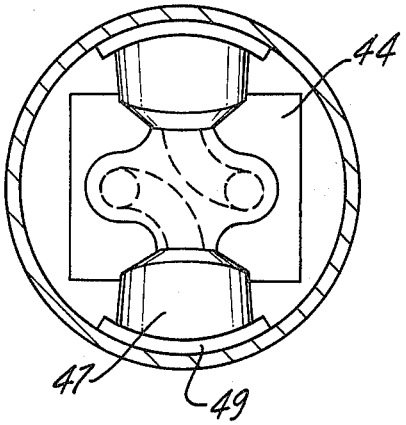
Fig-4
Fig-5
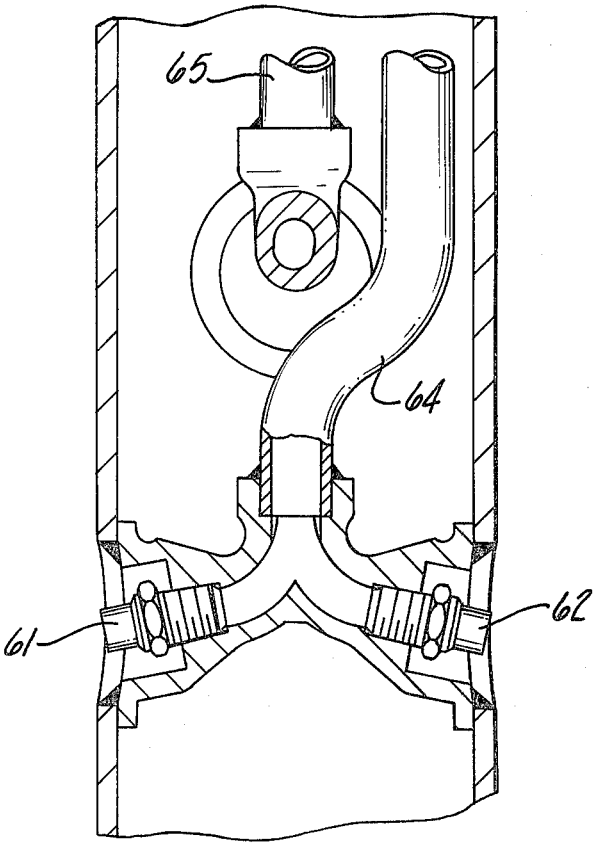
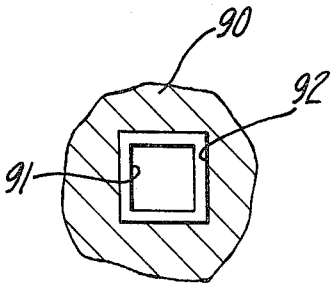
Fig-9

PULSED LIQUID JET-TYPE CLEANING OF HIGHLY HEATED SURFACES

BACKGROUND OF THE INVENTION

Since the advent of high temperature water tube boilers which burn fuels having substantial slag content, and also with the adoption of certain high temperature processing-type heat exchangers, the removal of adherent deposits from the fire side surfaces has been an increasingly severe problem. Sootblowers employing jets of steam and/or air cannot remove some such deposits. It has long been known that jets of water can be used to assist in slag removal, and it was also understood for many years that the thermal shock and resultant embrittlement of the slag caused by a water jet, combined with the energy of the jet itself, could often dislodge slag not removable from a steaming boiler by other means. However, until the advent of the so-called constant jet progression system disclosed in U.S. Pat. No. 3,782,336 granted Jan. 1, 1974 to J. E. Nelson, it was frequently impractical to use water jets for this purpose, because it was not possible to control and limit the thermal shock to a value which would avoid premature failure of the tubes. Prior to the advent of the constant jet progression system, very costly damage had been caused by some uses of water under difficult cleaning conditions.

Basically, the present invention aims to improve upon the Nelson constant jet progression water lance-type cleaning systems as currently used by increasing still further, and to a very substantial degree, the ratio between the peak impact pressure exerted by the jet and both the water volume required and the thermal shock imposed on the tubes.

A related object is to provide means for removing such deposits more quickly and economically than has heretofore been feasible without damage to the heat exchanger.

A further object is to increase the overall efficiency of the boiler by substantially reducing the absorption of heat from the gas stream by the cleaning medium.

Other objects and advantages of the invention will become apparent to persons skilled in the art upon consideration of the present disclosure in its entirety.

BRIEF DESCRIPTION OF THE FIGURES OF DRAWINGS

FIG. 4 is a cross-section taken substantially on the line IV—IV of FIG. 3 and looking in the direction of the arrows;

FIG. 5 is a sectional view similar to FIG. 3 showing the nozzle arrangement employed in a somewhat modified pulsing system;

FIG. 9 is a detailed sectional view taken substantially on the line IX—IX of FIG. 8 and looking in the direction of the arrows;

DETAILED DESCRIPTION OF PREFERRED FORMS OF THE INVENTION

Figure 1:
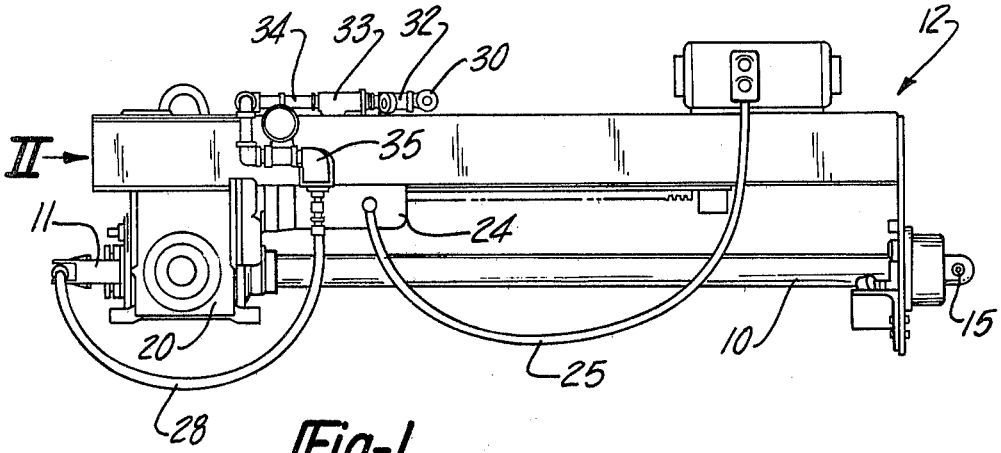
FIG. 1 is a somewhat diagrammatic side elevational view of a cleaning device employed in connection with and incorporating principles of the present invention.
Figure 2:
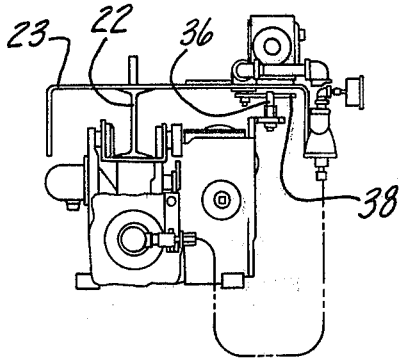
FIG. 2 is a rear elevational view taken as indicated by the arrow I in FIG. 1.

FIGS. 1 and 2 illustrate somewhat diagrammatically a long travel sootblower 12 of the well known "IK" type, designed to project a liquid blowing medium (typically water) against the deposits (typically slag) which form on fire side surfaces in a boiler or other high temperature heat exchanger. The sootblower is illustrated to typify a liquid projecting device which is adapted to be used in connection with the present invention. Other types might be employed, and specific details of the blower do not form a part of the present invention. Blowers of the "IK" type are illustrated and described in detail in numerous U.S. and foreign patents, including U.S. Pat. No. 2,668,978 to L. S. DeMart, issued Feb. 16, 1954, and U.S. Pat. No. 3,439,376, to John E. Nelson et al, issued Apr. 22, 1969.

As is typical with such blowers, an elongated lance tube 10 is adapted to be projected into and retracted from the interior of the boiler. (The term "boiler" is used for convenience with the intent that it be construed to include other heat exchangers from which it is desired to remove deposits located on fire side surfaces). When used in a typical boiler application to deslag a water wall area, the lance tube 10 is projectable through the water wall so that one or more nozzles as 15 located near the end of the lance tube are effective to project the blowing medium angularly rearwardly against the inner slagged surface of the wall. While operating in the boiler the lance tube is moved angularly and axially so that, depending upon whether the lance tube is rotated throughout a full 360°, or less than 360°, the jet will impact the slagged surface along a path in the form of a spiral or an interrupted spiral.

This type of blowing pattern is commonly used with blowers of various designs, as will be recognized. In blowers of the illustrated type the lance tube 10 is rotatably supported at its rear end in a carriage 20 rollably mounted on the bottom flange of an I-beam 22 which forms the main structural supporting member and which is shielded by a protective inverted U-channel-type hood 23. A motor 24 on the carriage and which is energizable through a flexible power cable 25 contains suitable gearing (not shown) by means of which it actuates the carriage to move it and the lance tube along the I-beam and also rotates the lance tube. Such carriage constructions and driving arrangements are also well known and illustrated in the prior patents mentioned above, and will not require description here.

The liquid blowing medium, which is typically water, but could be an aqueous solution containing a treatment medium, is supplied to the lance tube 10 through a coupling 11 at the rear end of the carriage and to which the lance tube is rotatably connected via a flexible hose 28. Liquid from a suitable high pressure source (not shown in FIGS. 1–4) is delivered at a pressure of 200–300 psi to a fitting 30 which is connected through a strainer 32 to a control valve 33 which is in turn connected through suitable piping as 34 and connecter 35 to the hose 28. The valve 33 is opened and closed by a lug 36 on the carriage. When the carriage moves forwardly from the retracted position shown in FIG. 1 to a position such that the nozzle end of the lance is inside the boiler, the lug strikes a trip arm 38 to actuate the valve 33 to the ON position, while when the carriage returns, the lug strikes the trip arm to actuate the latter in the reverse direction to close the valve.

In order to maximize the impact effect of the blowing medium, means is provided to periodically interrupt the flow to the nozzle or nozzles, to cause the liquid to be discharged in the form of discrete pulses. The spacing between the pulses is so related to the rate of progression of the jet over the surface to be cleaned that the leading end of each pulse strikes an area contiguous to the previous pulse but which is relatively free of liquid from the previous pulse. In other words, if the rate of progression of the jet impact position over the treated surface is not fast enough to prevent two or more successive pulses from striking the same area, the spacing between the pulses is made great enough so that liquid from a preceding pulse is substantially dissipated before a following pulse strikes the surface. This avoids cushioning of the impact of a successive pulse by liquid from a preceding pulse. As is known, the peak impact pressure of a pulsed jet can be as much as 50 times greater than that of a continuous jet. Dislodgement of the slag or other deposited material from the heated surface is greatly aided by the interruption of the supply to form such pulses.

Figure 3:
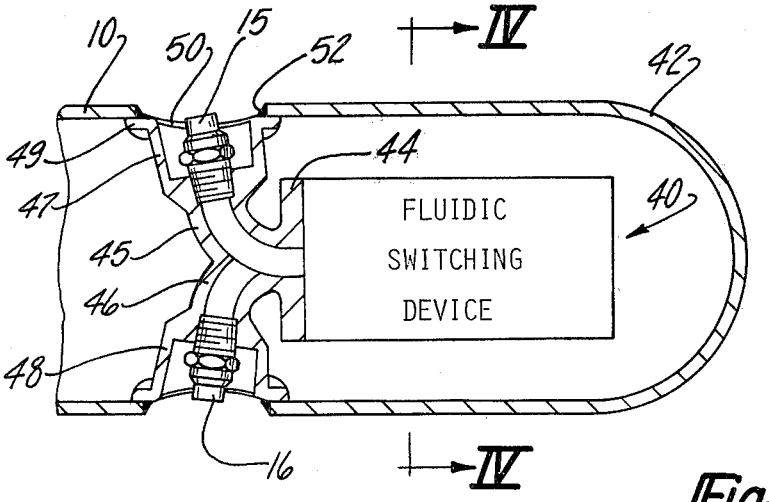
FIG. 3 is a somewhat diagrammatic longitudinal sectional view on a larger scale of the nozzle portion of the lance tube showing fluid pulsing and nozzle means.

As shown in FIGS. 3 and 4, an oscillating type fluidic switching device, generally designated 40, is mounted in the nozzle body 42 at the outer end of the lance tube 10 on a flange 44 which is integral with a pair of outlet elbow portions 45, 46. Each of the elbow portions 45, 46 has an enlarged and countersunk outer end portion 47, 48 respectively, the outer extremity of which has a flange as 49 proportioned to fit snugly against the inner wall of the lance and nozzle end portions and to be sealed as by welding, as indicated at 52 with respect to an opening 50 through which the liquid is discharged via the nozzle members 15, 16. The nozzles may be of a conventional commercially available construction adapted to project a concentrated high velocity jet, and are removably threadably fitted into the bottom of the countersunk portion 47. The fluidic switching device alternately directs the blowing medium to the nozzles 15, 16, typically in pulses and intervals of equal length.

The motor 24 is of a variable speed type, and its speed is controlled in the manner taught in Nelson U.S. Pat. No. 3,782,336, granted Jan. 1, 1974, in such manner as to maintain the rate of jet progression substantially constant despite the spiral contour of the path of the jet. With a pulse frequency of the order of 50 Hz and jet progression velocity on the order of 60 inches per second, each pulse and gap are approximately 24 inches long. Each pulse thus contains a substantial mass of water and is capable of delivering a relatively high impact. The pulse path length from the commencement of one pulse to the commencement of a succeeding pulse is approximately 1.2 inches. The nozzles are designed to project a jet of small diameter, and at least a portion of each pulse will strike an area of the path which is substantially free of water from the preceding pulse.

It is advisable to employ frequencies of pulsation which avoid any tendency to substantially reinforce the natural period of oscillation of the sootblower. Although the jet reaction forces created by the arrangement shown in FIGS. 3 and 4 impose lateral oscillating forces on the lance tube, these forces are of a frequency much higher than any natural frequency (or low harmonic of a natural frequency) of the lance tube. In measurements of the natural frequency of such a lance tube, it was found that the maximum natural frequency of oscillation was less than 10 hertz.

In the modification shown in FIG. 5 the output of the fluidic switching device is alternately delivered to each of two pairs of nozzles. Both of the diametrically opposed nozzles 61, 62 are connected via conduit 64 to one output of the fluidic oscillating switcher, and a second pair of diametrically opposed nozzles (not shown), arranged at 90° to the nozzles 61, 62, are both connected via conduit 65 to the other output of the switcher. Due to the simultaneous discharge of the pulses from the opposed nozzles, no oscillatory forces are applied to the lance tube laterally of the axis.

Figure 6:
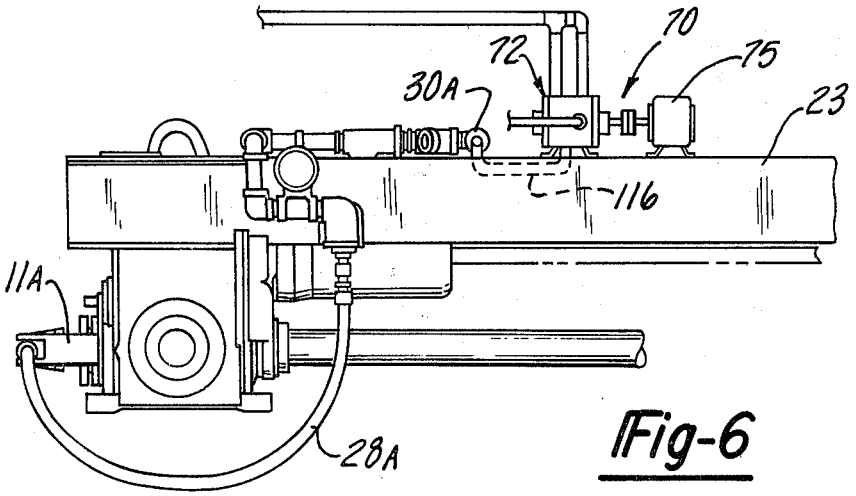
FIG. 6 is a fragmentary side elevational view of the central portion of a sootblower equipped with pulsing means of a modified construction.
Figure 10:
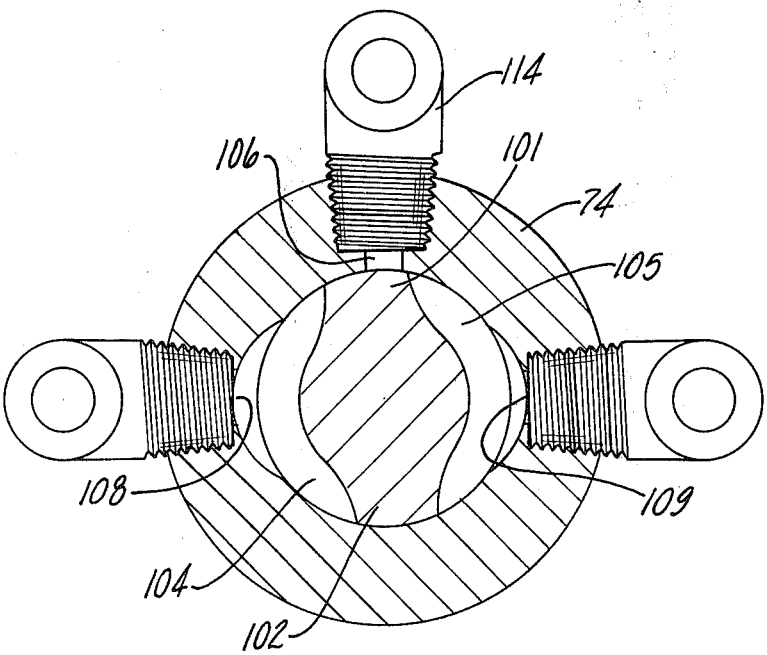
FIG. 10 is a cross-section taken substantially on the line X—X of FIG. 7 and looking in the direction of the arrows.

FIGS. 6–14 inclusive show a modification wherein the pulsing mechanism is adapted to be installed in the blowing medium supply system between the source and the inlet fitting 30A. (Parts corresponding to elements already described are designated by like reference characters distinguished by the addition of the letter "A", and many will not require redescription). The pulsing unit, generally designated 70, consists of a rotary pulse generator, generally designated 72, and a motor 75. The pulsing unit is adapted to be mounted on the blower, as by attachment to the protective hood channel 23, as shown in FIG. 6.

The pulsing unit comprises a cylindrical body 74 suitably closed by end bearing caps 76, 77, from the latter of which the driving shaft 78 extends for connection to the shaft of the motor, which may be a conventional induction motor rotating at approximately 1800 rpm. The cylindrical chamber 85 in the body 74 contains a rotor 90 accurately fitted and rotatable therein and fast with respect to shaft 78. A diametric passage 91 of square cross section extends through rotor 90 near one end, shown at the left in FIG. 7, and when the shaft is rotated acts as a pulsing or interrupter valve, and at each half turn of the rotor provides connection between diametrically opposed square-sectioned pulsed fluid inlet and outlet ports 92, 93. Inlet port 92 is slightly larger in cross section than the passage 91 in the rotor. Outlet port 93 is the same size as passage 91.

Figure 7:
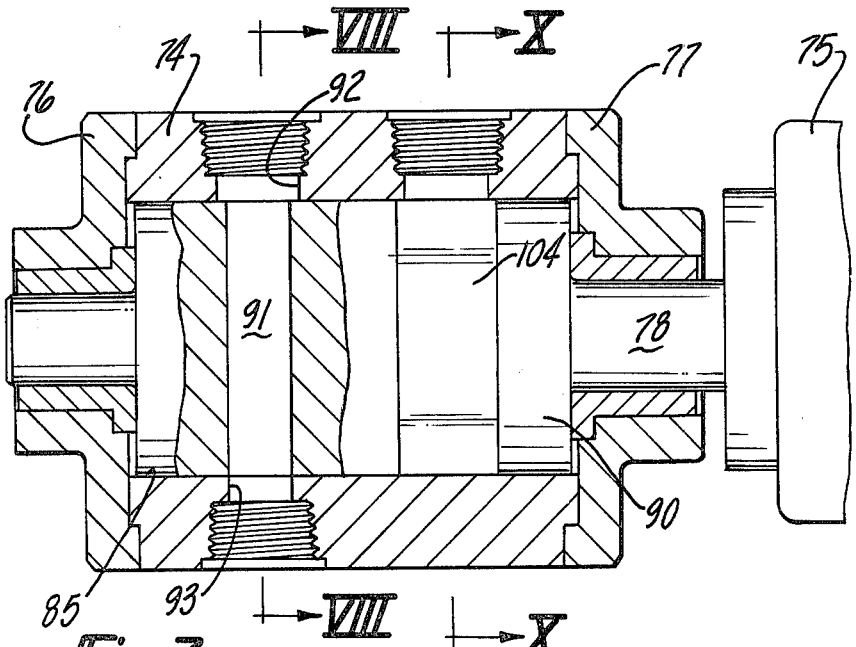
FIG. 7 is a somewhat diagrammatic view of the modified pulse generatng means, partly in longitudinal section and partly in side elevation.
Figure 8:
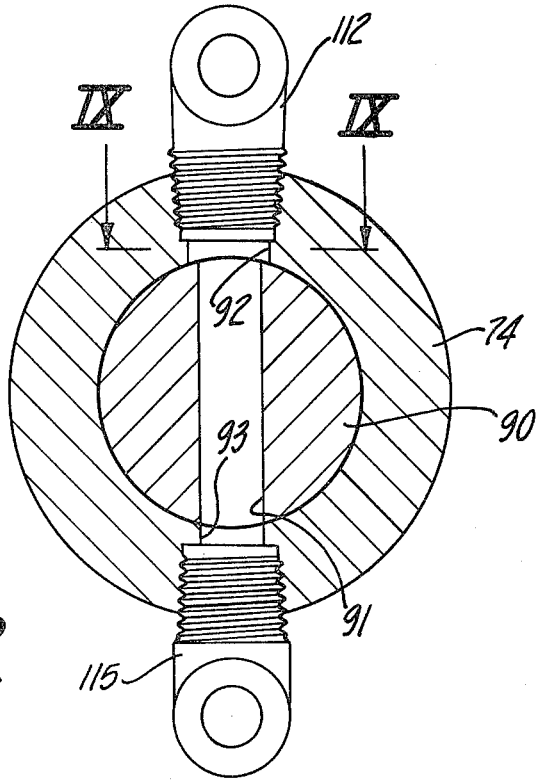
FIG. 8 is a cross-section taken substantially on the line VIII—VIII of FIG. 7 and looking in the direction of the arrows.
Figure 11:
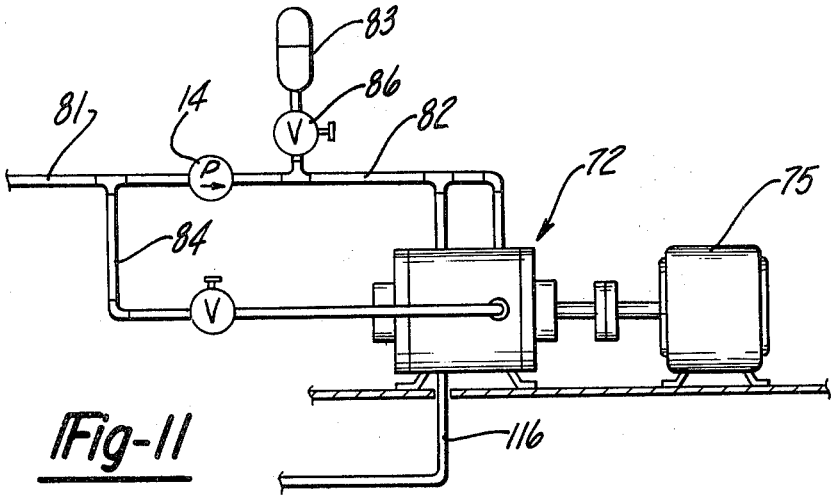
FIG. 11 is a diagrammatic hydraulic layout drawing of the modified pulse generating means installation.
Figure 12:
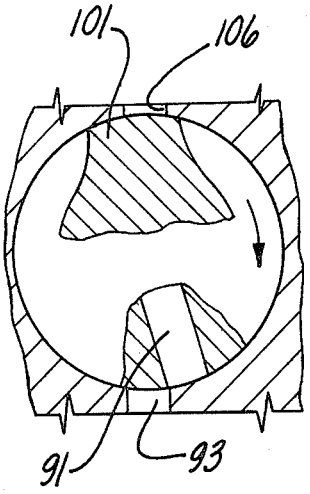
FIGS. 12, 13 and 14 are timing diagrams showing successive positions of components of the modified pulsing mechanism.
Figure 13:
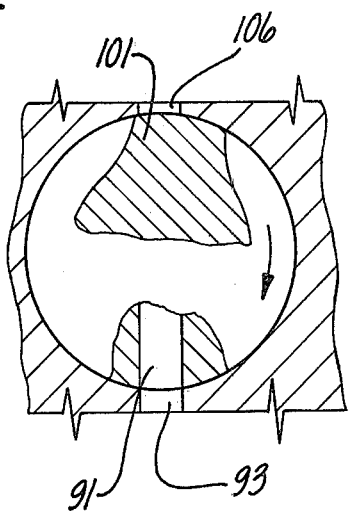
Figure 14:
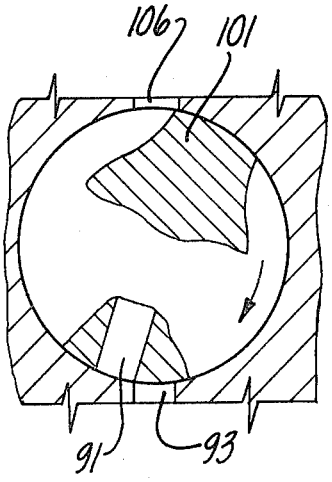

Near its right end (as shown in FIG. 7) the rotor is cut away in two diametrically opposed areas 104, 105 to create opposed lobe portions 101, 102 which rotate in alignment with and periodically block a bypass fluid inlet port 106 in the body 74 at each half turn of the rotor, forming a bypass or discharge valve which is actuated in timed relation to the pulsing valve. Two diametrically opposed bypass outlet ports 108, 109 extend through the wall of the housing 74 in transverse alignment with and at 90° to the bypass inlet port 106. Outlet ports 108, 109 are always in communication with inlet port 106 via clearance areas 104, 105, except when port 106 is obstructed by one of the lobes 101, 102. FIGS. 12–14 show the relative orientation of the lobes and of the passage 91 whereby the bypass inlet port 106 is blocked by one of the lobes 101, 102 whenever passage 91 provides communication between ports 92, 93.

Both of the ports 92 and 106 are connected as by suitable fittings 112, 114 to a supply of liquid under pressure, shown as delivered from a supply main 81 via a booster pump 14 and a delivery pipe 82. An accumulator 83 may be connected to pipe 82 via a manual valve 86 to enable controlling the peak surge pressure or "hammer" to any desired degree. The bypass discharge ports 108, 109 are connected to the main 81 upstream from the pump by pipe 84. The pulsed fluid from outlet 93 is conducted via a suitable fitting 115 and pipe 116 to the fitting 30A which supplies the lance tube via hose 28A and connector 11A.

By virtue of the square contour of the passage 91 and of the ports 92, 93, the front and rear faces of which are perpendicular to the direction of rotation, and due to the rapid rotation of the rotor, the flow is started and cut off quickly and fully, to form discrete pulses without substantial taper at either end. More precisely, it will be recognized that the word "square" merely refers to a convenient form of rectangle, and that in fact the feature in question does not specifically depend upon a rectangular cross section, but results from the fact that the surfaces which lie at positions corresponding to the leading and following surfaces of the rotating mass of liquid are flat and substantially perpendicular to a line tangent to a circle described by a point on the rotor.

The lobes 101, 102 are somewhat wider than the bypass inlet port 106 so that, as brought out in FIG. 12, the bypass is closed slightly prior to the opening of pulse outlet port 93, thereby causing a pressure build-up which creates an increase in the peak pressure at the start of the pulse.

This detailed description of preferred forms of the invention, and the accompanying drawings, have been furnished in compliance with the statutory requirements to set forth the best mode contemplated by the inventors of carrying out the invention. The prior portions consisting of the "Abstract of the Disclosure" and the "Background of the Invention" are furnished without prejudice to comply with administrative requirements of the Patent and Trademark Office.

While preferred forms of the invention have been illustrated and described, it will be recognized that changes may be made within the fair and reasonable scope of the appended claims without departing from the properly patentable scope of the invention.

We claim:

1. The method of dislodging an adherent coating from the coated area of the heated surface of a heat exchanger or the like, which comprises projecting a high velocity liquid jet in the form of a plurality of discrete pulses against the coated area in a predetermined spacing and sequence, moving the jet over the coating at a controlled rate of progression, and forming said pulses by interrupting the jet with a frequency high enough to cause the leading portion of at least one pulse to strike the coating during each increment of movement of the jet which corresponds to the diameter of the jet at the position of impact, the duration of interruption being long enough to permit the liquid of each pulse to substantially dissipate from an area impacted thereby before a succeeding pulse strikes the same area.

2. A method as defined in claim 1 wherein the liquid is projected through a lance tube which is moved both longitudinally of and angularly about its axis to cause the positions of impact of the pulses on the coated area to progress at a controlled rate along a predetermined path, the frequency of the pulses lying outside the range of natural frequencies of oscillation of the lance tube.

3. Means for dislodging an adherent deposit from the heated area of a heat exchanger or the like, comprising a water lance for projecting liquid cleaning medium in the form of a jet against the deposit, and means for moving the lance both axially and angularly to move the jet over the deposit at a controlled rate of progression, characterized by means for sequentially interrupting the jet to create pulses of a frequency high enough to cause the leading portion of at least one pulse to strike the deposit during each increment of movement of the jet which corresponds to the diameter of the jet at the position of impact, the frequency of interruption of the jet lying outside the range of natural frequencies of oscillation of the lance.

4. Means as set forth in claim 3 wherein said lance is provided with a plurality of nozzles through which the cleaning medium is dischargeable, and the interrupting means comprises a fluidic switching device within the lance having an inlet within the lance and having a plurality of outlets connected to different ones of said nozzles to alternately direct and interrupt flow of the medium to different ones of said nozzles for discharge therethrough in discrete pulses.

5. Means as defined in claim 3 wherein said lance has an inlet adapted to be connected to a source of liquid under pressure, pulse generating means connectable in interposed relation between such a source and said inlet, said pulse generating means comprising a motor driven interrupter valve portion having an inlet for connection to said source and having an outlet for connection to said inlet of the lance and operable to open and closed positions in which it periodically establishes and interrupts communication between the source and the lance, and a bypass valving portion operatively connected to the interrupter valve portion to be driven in timed relation thereto to open and close a bypass which bypasses fluid from said source around the interrupter valve portion during each period in which said interrupter valve portion is open.

6. Means as set forth in claim 5 including means for closing the bypass valve portion somewhat before the interrupter valve opens.

7. Means as set forth in claim 5 or claim 6 wherein said valve portions are rotatable as a unit to open and close the same.

8. Means as set forth in claim 5 or claim 6 wherein the interrupter valve portion includes a body having an inlet port therein and having an outlet port of rectangular cross section, and a rotor having a valving passage including a portion of rectangular cross section movable into and out of registry with said outlet port by rotation of the rotor.

9. Means as set forth in claim 5 or claim 6 wherein the interrupter valve portion includes a body having an inlet port therein and having an outlet port, and a rotor having a valving passage portion movable into and out of registry with said outlet port by rotation of the rotor, said outlet port and valving passage portion having leading and following sides which are substantially flat and perpendicular to a tangent line at a circle of rotation of the rotor.

* * * * *